US006361839B1

(12) United States Patent
Salgado et al.

(10) Patent No.: US 6,361,839 B1
(45) **Date of Patent: *Mar. 26, 2002**

(54) HOT STAMPING FOIL AND PROCESS

(75) Inventors: Saul Salgado, San Ysidro; Saul Heiman, La Jolla; Bruce Gindelberger, San Diego; Snehal Desai, El Cajon, all of CA (US)

(73) Assignee: National Ink Incorporated, Santee, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/327,839

(22) Filed: Jun. 8, 1999

Related U.S. Application Data

(63) Continuation-in-part of application No. 08/509,425, filed on Jul. 31, 1995, now Pat. No. 5,925,593.

(51) Int. Cl.[7] ..... B41M 5/26

(52) U.S. Cl. ..... 428/29; 428/195; 428/913; 428/914; 503/202; 503/214

(58) Field of Search ..... 428/195, 913, 428/914, 484, 488.1, 488.4, 480, 331, 29; 503/201, 202, 214; 427/146

(56) References Cited

U.S. PATENT DOCUMENTS 4,684,271 A * 8/1987 Wellman et al. ..... 400/241.1
5,734,396 A * 3/1998 Hale et al. ..... 347/54
5,925,593 A * 7/1999 Salgado et al. ..... 503/201

FOREIGN PATENT DOCUMENTS

JP 04218583 * 8/1997

* cited by examiner

*Primary Examiner*—Bruce H. Hess
(74) *Attorney, Agent, or Firm*—Pillsbury Winthrop LLP

(57) ABSTRACT

A hot stamping foil includes a carrier, and disposed thereon, a thermochromic layer. The thermochromic layer includes a mixture of a thermochromic compound, a sizing or adhesive compound, a release compound, and an antimicrobial compound. The hot stamping foil is useful in creating various visual effects and also preventing the growth of microbes on a medium to which the hot stamping foil is applied.

15 Claims, 1 Drawing Sheet

HOT STAMPING FOIL AND PROCESS

This application is a continuation-in-part application of application Ser. No. 08/509,425, filed Jul. 31. 1995, now U.S. Pat. No. 5,925,593.

FIELD OF THE INVENTION

The present invention relates to an improved hot stamping foil, more particularly to a hot stamping foil having a layer which includes a thermochromic compound and an antimicrobial compound.

BACKGROUND OF THE INVENTION

Various systems for transferring ink images onto a substrate, such as a fabric or an article of manufacture, are known. For example, images can be transferred from a heat transfer sheet by the use of heat and pressure. Such sheets (also known as hot-stamp foils) are shown, for example, in U.S. Pat. No. 5,124,309, to Egashira, and U.S. Pat. No. 5,223,476, to Kanto et al.

More complex systems for transferring images are shown, for example, in U.S. Pat. No. 5,244,524, to Yamane. Yamane describes an ink image forming step in which an ink image is formed on a hot melting type adhesive layer of a transfer sheet, followed by an image retransferring step in which the ink image and the hot melting type adhesive layer are transferred onto the substrate by application of heat and pressure.

Various inks and dyes have been employed in known heat transfer sheets or hot-stamp foils. For certain applications, it would be desirable to employ a so-called thermochromic compound, that is, a compound which changes color (typically from colored to colorless or vice versa) at a specified transition temperature. Images so formed can, for example, provide an indication of the temperature of the substrate to which they are applied, or can provide a decorative effect.

Once an image is transferred to a medium, it becomes susceptible to attack by microbes. These microbes feed on the image and the surrounding medium; if present in sufficient numbers, they degrade the appearance of the image and can degrade even the medium itself. One can address this problem by transferring an image to a fabric coated with an antimicrobial agent, as is taught by Rubin et al in U.S. Pat. No. 5,565,265. The fabric thus coated is said to be effective in retarding the growth of microbes.

In a similar manner, one can incorporate an antimicrobial compound directly into plastic products to retard the growth of microbes. The typical method mixes a preservative with the plastic before the plastic is molded or rolled into a sheet. This method has its drawbacks, however. Certain plastics, such as polystyrene, may inhibit the effectiveness of the antimicrobial compound. This method is moreover wasteful: in all molded plastic items, a large proportion of the antimicrobial compound used is unavailable because it is sealed within the plastic. This large proportion is not exposed to the surface, where microbes attack.

It would be desirable to provide an improved hot-stamp foil comprising a layer which includes a thermochromic compound, and preferably a thermochromic layer which provides a reversible thermochromic effect. It would be further desirable to impart microbial resistance to an image transferred by the improved hot-stamp foil.

SUMMARY OF THE PREFERRED EMBODIMENTS

In accordance with one aspect of the present invention, there has been provided a hot stamping foil comprising a carrier, and disposed thereon, a thermochromic layer comprising a mixture of a thermochromic compound, a sizing or adhesive compound, a release compound, and a antimicrobial compound.

In accordance with another aspect of the present invention, a method of producing a hot stamping foil is provided which comprises the steps of: preparing a thermochromic mixture comprising a thermochromic compound, a sizing or adhesive compound, a release compound, and an antimicrobial compound; and applying to a carrier layer a layer of the thermochromic mixture.

According to a further aspect of the present invention, an article of manufacture is provided comprising a substrate and, applied thereto, a hot stamping foil as described above.

According to yet another aspect of the present invention, a method of labeling an article of manufacture is provided comprising the steps of: contacting the thermochromic layer of the hot stamping foil described above with the article; hot stamping the hot stamping foil to cause the thermochromic layer to adhere to the article; and removing the carrier of the hot stamping foil from the thermochromic layer.

The hot stamping foil of the present invention may be applied to a variety of plastics, even to many plastics which inhibit the effectiveness of the antimicrobial compound, and may also be applied to other items that are not made of plastic such as wood, paper, and leather.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWING

The invention may be more readily understood by referring to the accompanying FIG. 1 which is a cross-sectional view of a hot-stamp foil according to the invention.

DETAILED DESCRIPTION OF THE PREFERRED EMBODIMENTS

Figure 1:
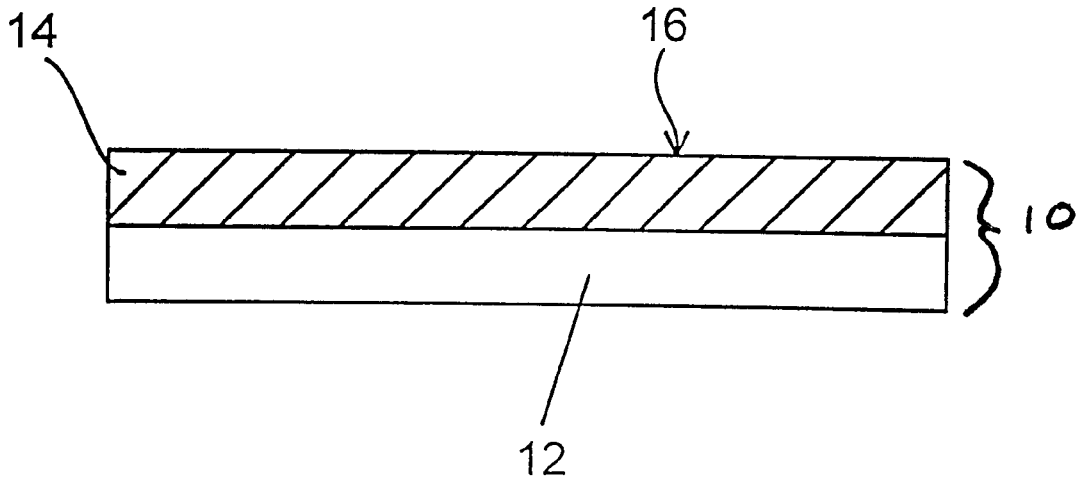

The present invention provides an improved thermochromic hot-stamp foil. The thermochromic layer of the inventive hot-stamp foil includes a thermochromic compound, a sizing or adhesive compound, and a release compound in a single layer. No additional release layer is needed between the thermochromic layer and the carrier layer, thus facilitating the manufacture and use of the inventive foil. Thermochromic compounds are described, for example, by Day, "Thermochromism of Inorganic Compounds," *Chemical Reviews* 68, p. 649 (1968); in U.S. Pat. No. 3,816,335, to Evans; U.S. Pat. No. 3,980,581, to Godsey; and in U.S. Pat. Nos. 4,105,583 and 4,121,011, to Glover, the disclosures of which are incorporated in their entireties by reference herein. Thermochromic compounds are readily available commercially, for example, from Matsui Shikiso Chemical Co., Ltd. (Kyoto, Japan) and Matsui and Company, Inc. (New Jersey).

The temperature of the color change, or "transition temperature," of a thermochromic composition depends on the environment and the rate of heating. The transition temperature of any specific thermochromic composition is readily determined by one of ordinary skill in the art. Typically, a range of temperature is required for complete transition from one color state to another. Thus, exemplary thermochromic compounds begin to change color at about 4° C., with completion at about 5° C.; at about 16° C., with completion at about 26° C.; at about 44° C., with completion at about 58° C.; etc.

Thermochromic compounds are produced in a variety of colors and exhibit a variety of color changes with increasing temperature, for example, vermilion to colorless; pink to colorless; turquoise blue to colorless; orange to yellow; black to sky blue; and black to yellow. Multiple color changes can be produced by use of combinations of thermochromic compounds with different transition temperatures, for example, brown to green to yellow.

The thermochromic layer according to the invention further comprises a sizing or adhesive compound. Useful sizing or adhesive compounds include, for example, polyacrylates, polyalkacrylates, vinyl resins including polyvinyl acetate, cellulose resins, polyacrylamides, ethylene/vinyl acetate copolymers, vinyl alcohol, and other such compounds known to those skilled in the art.

The thermochromic layer also comprises a release compound. The release compound facilitates separation of the thermochromic layer from the carrier layer. Useful release compounds include those known to the art, such as microcrystalline wax, rice wax, oricuri wax, polyglycols, stearic acid esters, metallic salts of fatty acids such as zinc, sodium, and lithium stearate, inorganic powders such as silica, and other compounds well known in the art.

The thermochromic layer according to the invention further comprises an antimicrobial compound. An antimicrobial compound is any compound or combination of compounds that kills a microorganism or prevents its growth, and includes antibiotic, antifungal, antiviral, and antialgal compounds. Antimicrobial compounds are widely known. They are readily available commercially from, for example, Dow Chemical Co., Morton Chemical Co., Troy Chemical Co., and Zeneca Chemical Co.

The thermochromic layer according to the invention preferably is reversibly thermochromic, that is, it reverts to its original color once it returns to the initial temperature range. In an embodiment of the present invention, the thermochromic layer also contains a non-thermochromic pigment.

The thickness of the thermochromic layer is about 0.1 to 0.3 mil. According to an embodiment of the present invention, the thermochromic layer is applied to a carrier film. The carrier film can be from 0.25 mil to 2.0 mil thick. The preferred film is polyester (with trade names Hostaphen or Mylar), but polyethylene terephthalate, cellophane, cellulose acetate propionate, and polyvinylidine fluoride ("Tefzel") can also be used.

Referring now to the drawing, as shown in FIG. 1, thermochromic foil 10 includes carrier 12 on which is disposed thermochromic layer 14 having an upper surface 16. In use, upper surface 16 is contacted with an object or surface which is to be labeled. Heat and pressure are applied to the foil 10. Carrier 12 is then removed, leaving thermochromic layer 14 affixed to the object to which it was applied.

This application process is known as hot stamping. The temperature used in this process ranges from 200° F. to as high a temperature as the carrier can take before melting. The preferred temperature range is 400° F. to 550° F.

The amount of pressure applied in the hot stamping process varies. Preferably around 7 to 9 pounds per square inch are applied for a period of about 0.5 to 2 seconds.

The invention is further illustrated by the following non-limiting examples:

EXAMPLE 1

A coating having the following formulation was prepared and applied to a carrier film:

| Ingredient | Amount (wt %) |
|---|---|
| Styrene acrylic emulsion | 27.5 |
| Ammonium zirconium carbonate solution | 6.5 |
| Sodium polyacrylate solution | 2.25 |
| Polyoxyethylene glycols | 0.125 |
| Microcrystalline wax | 5.0 |
| Deionized water | 4.625 |
| Isopropyl alcohol | 4.0 |
| Yellow thermochromic pigment dispersion | 50.0 |

The formulation was prepared by first premixing the sodium polyacrylate solution with the ammonium zirconium carbonate solution. Then the styrene acrylic emulsion was added. Next was added the microcrystalline wax, deionized water, isopropyl alcohol and polyoxyethylene glycols. Lastly, the yellow thermochromic pigment dispersion was added. Mixing was done at a shear to avoid rupturing the encapsulated pigment.

The formulation affords a yellow color at the thermochromic temperature, and a white transparent (clear) residual coloring when the thermochromic pigment coloration disappears.

EXAMPLE 2

In the same manner as Example 1, the following coating formulation was prepared and applied to a carrier film:

| Ingredient | Amount (wt %) |
|---|---|
| Styrene acrylic emulsion | 22.55 |
| Ammonium zirconium carbonate solution | 5.33 |
| Sodium polyacrylate solution | 1.845 |
| Polyoxyethylene glycols | 0.103 |
| Microcrystalline wax | 4.1 |
| Deionized water | 3.792 |
| Isopropyl alcohol | 3.28 |
| Blue thermochromic pigment dispersion | 58.5 |
| Yellow pigment dispersion | 0.5 |

The formulation affords a green color at the thermochromic temperature, and a yellow residual coloring when the thermochromic pigment coloration disappears.

EXAMPLE 3

The following coating formulation was prepared and applied to a carrier film:

| Ingredient | Amount (wt %) |
|---|---|
| Styrene acrylic emulsion | 27.5 |
| Ammonium zirconium carbonate solution | 6.5 |
| Sodium polyacrylate solution | 2.25 |
| Polyoxyethylene glycols | 0.125 |
| Microcrystalline wax | 5.0 |
| Deionized water | 4.625 |

-continued

| Ingredient | Amount (wt %) |
|---|---|
| Isopropyl alcohol | 4.0 |
| Magenta thermochromic pigment dispersion | 50.0 |

The formulation affords a magenta color at the thermochromic temperature, and a white transparent (clear) residual coloring when the thermochromic pigment coloration disappears.

EXAMPLE 4

The following coating formulation was prepared and applied to a carrier film:

| Ingredient | Amount (wt %) |
|---|---|
| Isopropyl alcohol | 25.0 |
| Huls resin CA (Ketone formaldehyde resin) | 30.0 |
| Microcrystalline wax | 5.0 |
| Blue thermochromic pigment dispersion | 40.0 |

The formulation affords a blue color at the thermochromic temperature and a white transparent (clear) residual coloring when the thermochromic pigment coloration disappears.

EXAMPLE 5

The following coating formulation was prepared and applied to a carrier film:

| Ingredient | Amount (wt %) |
|---|---|
| Acryloid NAD-10 (acrylic resin dispersion in mineral spirits) | 40.0 |
| Mineral spirits | 6.0 |
| Microcrystalline wax | 4.0 |
| Red thermochromic pigment dispersion | 40.0 |
| Yellow pigment dispersion | 10.0 |

The formulation affords a red color at the temperature and a yellow residual coloring when the thermochromic pigment coloration disappears.

EXAMPLE 6

A coating having the following formulation was prepared and applied to a carrier film.

| Ingredient | Amount (wt %) |
|---|---|
| Styrene Acrylic Emulsion | 61.65 |
| Ammonium zirconium carbonate solution | 8.65 |
| Sodium polyacrylate solution | 2.44 |
| Microcrystalline Wax | 5.00 |
| Deionized water | 15.22 |
| Propylene glycol monomethyl ether | 4.60 |
| Ammonium hydroxide | 0.44 |
| Diisodecylphthalate | 1.96 |
| 10, 10 oxybisphenoxyarsine | 0.04 |

The coating when transferred to a plastic item provides a barrier containing about 800 parts per million of the antimicrobial compound 10, 10 oxybisphenoxyarsine. (Morton Vinyzene BP-5-2-DIDP) Biological challenge tests run showed that the coating was effective in inhibiting the growth of gram positive and gram negative bacteria and various molds.

EXAMPLE 7

A coating having the following formulation was prepared and applied to a carrier film.

| Ingredient | Amount (wt %) |
|---|---|
| Styrene acrylic emulsion | 42.55 |
| Melamine acrylic emulsion | 4.00 |
| P-toluene sulfonamide catalyst | 0.10 |
| Microcrystalline Wax | 7.44 |
| Deionized water | 15.60 |
| Isopropyl alcohol | 3.50 |
| Ammonium hydroxide | 0.56 |
| Pigment Blue 15 dispersion | 26.00 |
| Diisodecylphthalate | 0.15 |
| Trichlorophenoxyphenol | 0.10 |

The hot stamp foil when transferred to a plastic item provides a blue barrier coating containing about 2000 parts per million of the antimicrobial compound trichlorophenoxyphenol. (Morton Vinyzene DP-7040 DIDP)

EXAMPLE 8

A coating having the following formulation was prepared and applied to a carrier film.

| Ingredient | Amount (wt %) |
|---|---|
| Styrene acrylic emulsion | 67.37 |
| Ammonium zirconium carbonate solution | 6.5 |
| Sodium polyacrylate solution | 2.3 |
| Polyoxyethylene glycols | 0.13 |
| Microcrystalline wax | 5.0 |
| Deionized water | 14.5 |
| Isopropyl alcohol | 4.0 |
| 3-iodo-2-propynyl butyl carbamate | 0.20 |

The hot stamp foil when transferred to a plastic item provides a barrier coating that contains about 3600 parts per million of the antimicrobial compound 3-iodo-2-propynyl butyl carbamate. (Troysan Polyphase WD-17)

EXAMPLE 9

A coating having the following formula was prepared and applied to a carrier film.

| Ingredient | Amount (wt %) |
|---|---|
| Isopropyl alcohol | 34.5 |
| Ketone formaldehyde resin | 60.0 |
| Microcrystalline wax | 5.0 |
| 3-iodo-2-propynyl butyl carbamate | 0.5 |

The hot stamp foil when applied to a wood surface provides a barrier coating that contains about 5000 parts per million of the antimicrobial compound 3-iodo-2-propynyl butyl carbamate.

What is claimed is:

1. A hot stamping foil comprising a carrier, and disposed thereon, a thermochromic layer comprising a mixture of:

a thermochromic compound, a sizing or adhesive compound, a release compound, and an antimicrobial compound;

wherein the thermochromic compound displays a thermochromic effect without chemical reaction with another compound.

2. The hot stamping foil of claim 1 wherein said carrier is comprised of a material selected from the group consisting of polyester, polyethylene terphthalate, cellophane, cellulose acetate butyrate, cellulose acetate propionate and polyvinylidine fluoride.

3. The hot stamping foil of claim 1 wherein said release compound is selected from the group consisting of silica, microcrystalline wax, rice wax, oricuri wax, stearic acid esters, polyglycols, and metallic salts of fatty acids.

4. The hot stamping foil of claim 1 wherein said sizing or adhesive compound is selected from the group consisting of vinyl alcohol, polyacrylates, polyalkacrylates, vinyl resins, polyvinyl acetate, cellulose resins, polyacrylamides, and ethylene/vinyl acetate copolymers.

5. The hot stamping foil of claim 1 wherein said thermochromic compound has a thermochromic temperature between about 4 and 58° C.

6. The hot stamping foil of claim 1 wherein said thermochromic layer further comprises a non-thermochromic pigment.

7. The hot stamping foil of claim 1 wherein said antimicrobial compound is a release compound, and an antimicrobial compound;

wherein the thermochromic compound displays a thermochromic effect without chemical reaction with another compound.

8. The hot stamping foil of claim 1 wherein said thermochromic layer has a thickness of about 0.1 to 0.3 mil.

9. A method of producing a hot stamping foil comprising the steps of:

preparing a thermochromic mixture comprising a release compound, a sizing or adhesive compound, a thermochromic compound, and an antimicrobial compound; and applying to a carrier a layer of said mixture.

10. The method of claim 9 wherein said thermochromic mixture is applied to said carrier in a thickness of about 0.1 to about 0.3 mil.

11. An article of manufacture comprising a substrate and, applied thereto, a hot stamping foil of claim 1.

12. A method of labeling an article of manufacture, the method comprising the steps of:

contacting the thermochromic layer of the hot stamping foil of claim 1 with said article;

hot stamping said hot stamping foil to cause said thermochromic layer to adhere to said article; and removing the carrier of said hot stamping foil from said thermochromic layer.

13. A hot stamping foil consisting essentially of a carrier, and disposed thereon:

a thermochromic compound, a sizing or adhesive compound, a release compound, and an antimicrobial compound.

14. A hot stamping foil comprising a carrier, and disposed thereon a thermochromic layer comprising a mixture of:

a thermochromic compound, a sizing or adhesive compound, a release compound, and an antimicrobial compound, wherein the thermochromic compound displays a thermochromic effect without chemical reaction with another compound, and wherein the thermochromic layer displays a reversible thermochromic effect.

15. A method of producing a hot stamping foil comprising the steps of:

preparing a thermochromic mixture comprising a release compound a sizing or adhesive compound a thermochromic compound, and an antimicrobial compound, wherein the thermochromic compound displays a thermochromic effect without chemical reaction with another compound; and applying to a carrier layer a layer of the mixture, wherein the layer of the mixture displays a reversible thermochromic effect.

* * * * *